US005203155A

United States Patent [19]

Wiese et al.

[11] Patent Number: 5,203,155

[45] Date of Patent: Apr. 20, 1993

[54] TUBE-SENSING DEVICE FOR DOFFING AND DONNING APPARATUS

[75] Inventors: Franz J. Wiese, Gradisca D'Isonzo, Italy; Martin Maeser, Albershausen, Fed. Rep. of Germany

[73] Assignee: Zinser Textilmaschinen GmbH, Ebersbach/Fils, Fed. Rep. of Germany

[21] Appl. No.: 799,820

[22] Filed: Nov. 25, 1991

[30] Foreign Application Priority Data

Nov. 23, 1990 [DE] Fed. Rep. of Germany ..... 4037312

[51] Int. Cl.[5] ..... D01H 9/04

[52] U.S. Cl. ..... 57/264; 57/275; 57/281

[58] Field of Search ..... 57/264, 274, 275, 281

[56] References Cited

U.S. PATENT DOCUMENTS

| | | | |
|---|---|---|---|
| 3,633,959 | 1/1972 | McCollough | 57/275 X |
| 3,791,124 | 2/1974 | Kaufmann | 57/274 |
| 3,895,482 | 7/1975 | Schulz et al. | 57/275 |
| 4,036,001 | 7/1977 | Tamai et al. | 57/275 X |
| 4,341,067 | 7/1982 | Kondo et al. | 57/275 |
| 5,014,505 | 5/1991 | Wernli et al. | 57/275 |
| 5,016,433 | 5/1991 | Putz et al. | 57/274 |
| 5,058,372 | 10/1991 | Staedele et al. | 57/275 X |

FOREIGN PATENT DOCUMENTS

| | | | |
|---|---|---|---|
| 365751 | 5/1990 | European Pat. Off. . | |
| 2158657 | 6/1972 | Fed. Rep. of Germany | 57/274 |
| 4030623 | 4/1991 | Fed. Rep. of Germany . | |
| 58-74468 | 5/1983 | Japan . | |
| 173320 | 10/1984 | Japan | 57/264 |
| 348907 | 10/1960 | Switzerland . | |

*Primary Examiner*—Joseph J. Hail, III

*Attorney, Agent, or Firm*—Herbert Dubno; Andrew Wilford

[57] ABSTRACT

A doffing apparatus for removing a row of yarn tubes from a row of upright spindles has a support and a row of grabs mounted on the support, each engageable with a respective tube of a respective spindle, and movable for lifting the tubes off the spindles. Respective sensors at the grabs detect the presence of tubes in the respective stations and generate individual outputs respectively corresponding to the absence of tubes in the respective stations. A controller connected to all the sensors receives the outputs therefrom and stops the apparatus on detection of no tube in any of the stations.

9 Claims, 2 Drawing Sheets

TUBE-SENSING DEVICE FOR DOFFING AND DONNING APPARATUS

FIELD OF THE INVENTION

The present invention relates to a textile spinning machine. More particularly this invention concerns a tube-doffing and -donning apparatus for a ring-spinning machine.

BACKGROUND OF THE INVENTION

In a standard ring-spinning machine respective filaments are wound up onto respective tubes on respective spindles carried in a long row on a bank of such spindles, and in some arrangements filaments are pulled off rows of tubes similarly mounted on spindles. An equally long doffing apparatus has respective grabs that engage the tops of the tubes and remove same from the spindles, while a similar such machine or even the same one can mount replacement tubes on the spindles.

It is clearly critical that the machine not try to load a new tube on a spindle where for some reason there is still a tube that was not removed in an earlier doffing cycle. Accordingly devices such as described in U.S. Pat. No. 3,791,124 of S. Kaufmann have a tube-detector comprised of a light beam that is directed the length of the spindle bank just above the upper ends of the spindles. Any tube, whether empty or full, left on a spindle will interrupt the beam and thereby indicate to a connected control system that something is wrong, so that donning and/or doffing can be interrupted while the problem is attended to, normally manually.

This system has several drawbacks. First of all it does not indicate which or how many spinning spindles are still carrying tubes. Thus the alarm and shutdown is triggered if there is a massive failure leaving all spindles full, or if only one spindle is left carrying a tube.

Another considerable disadvantage is that it does not indicate that a given spindle never had a tube, so that the machine can continue and will wind on filament onto the naked spindle. When a subsequent effort is made to fit a tube to this spindle, same will be blocked by the yarn and will break the new tube and/or the apparatus, creating a considerable problem.

OBJECTS OF THE INVENTION

It is therefore an object of the present invention to provide an improved tube-sensing apparatus for a spinning machine.

Another object is the provision of such an improved tube-sensing apparatus for a spinning machine which overcomes the above-given disadvantages, that is which indicates where and which spindles do not have tubes.

SUMMARY OF THE INVENTION

A doffing apparatus for removing a row of yarn tubes from a row of upright spindles according to this invention has a support and a row of grabs mounted on the support, each engageable with a respective tube of a respective spindle, and movable for lifting the tubes off the spindles. Respective sensors at the grabs detect the presence of tubes in the respective stations and generate individual outputs respectively corresponding to the absence of tubes in the respective stations. A controller connected to all the sensors receives the outputs therefrom and stops the apparatus on detection of no tube in any of the stations.

Thus this system does not detect the presence of a tube on a spindle after a doffing operation, but instead detects the presences of tubes in the grabs after such an operation. Thus if a station started out empty, no tube will be picked up and this signal will be generated, or if a tube slips out of its grab or something else happens leaving the respective grab empty an error output will be sent. The error output will indicate not only that something is wrong, but where this is happening so the operator can know if only one spindle needs attention or if several do.

According to the invention the sensors are electromechanical. Each grab includes an abutment element, a pusher element displaceable toward and away from the abutment element, and an actuator for pushing the pusher element toward the abutment element and clamping the respective tube between the elements. The sensor is a switch operated by movement of one of the elements. It can be a normally open or closed switch, with the output corresponding to flow or no flow of current in a respective circuit.

In one arrangement each abutment element is generally fixed on the support and the respective pusher element is movable from a fully retracted position spaced relatively far from the respective abutment element to a fully advanced position relatively close to the respective abutment and through an intermediate position. The positions are spaced such that on engaging a tube each pusher element is arrested in the intermediate position. Furthermore each switch is actuated by being opened or closed only when the respective pusher element moves into the respective fully advanced position. A respective spring in each grab urges the respective pusher element into the fully retracted position.

Furthermore according to the invention each abutment element can be movable between an advanced position relatively close to and a retracted position relatively far from the respective pusher element. A respective spring in each grab urges the respective abutment element into the advanced position and each switch is actuated when the respective abutment element moves into the advanced position. Thus only when the abutment element is pushed back by the pusher element pressing a tube against it is the alarm or output generated.

In another arrangement according to this invention the sensors are optoelectric, including means for emitting light at a location in the respective grab normally occupied by a tube being doffed and means for detecting that the emitted light is reflected by a tube.

BRIEF DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
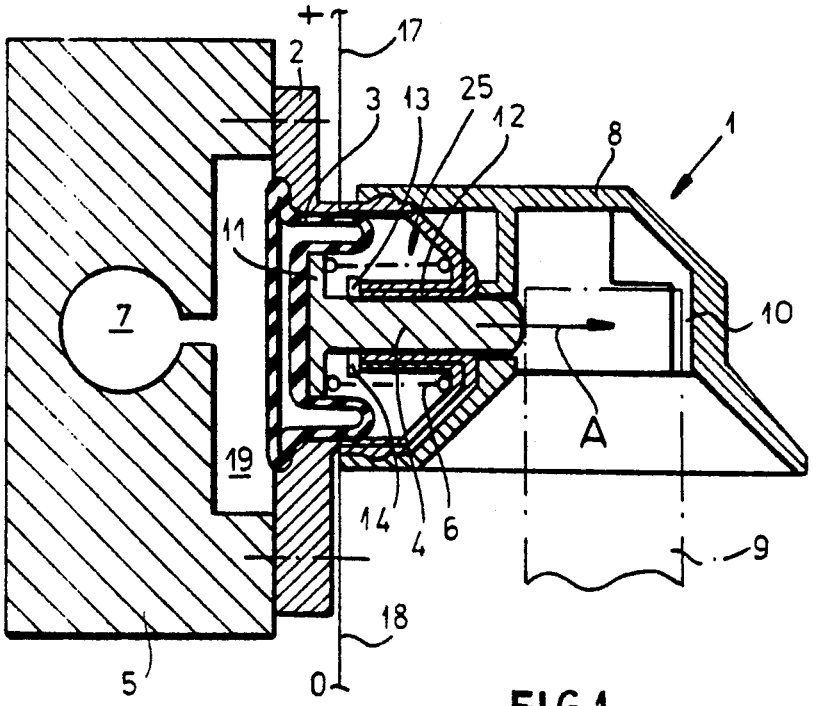
FIG. 1 is a partly diagrammatic vertical section through a grab according to this invention.
Figure 2:
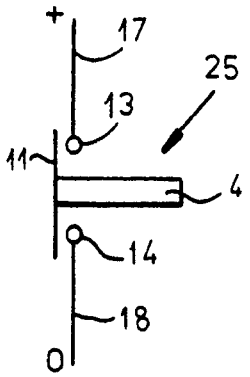
FIG. 2 is a schematic view of the circuitry of the grab of FIG. 1.
Figure 3:
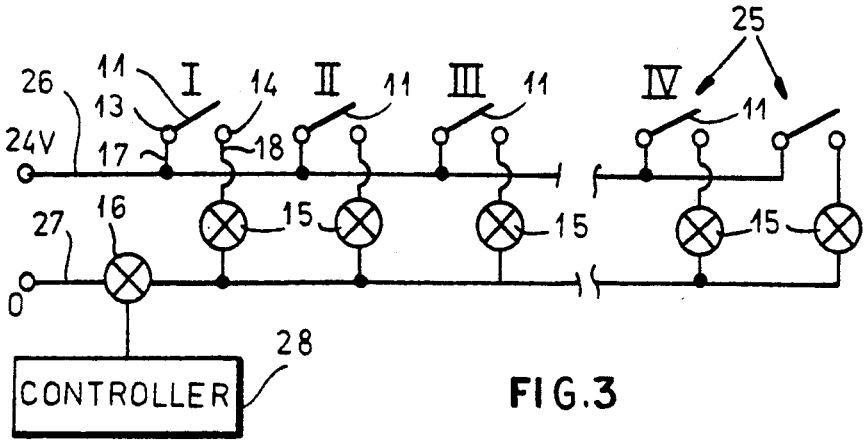
FIG. 3 is a circuit diagram of the control system of the invention.

As seen in FIGS. 1 through 3 a grab 1 is mounted on a respective support 2 itself secured to a main support beam 5 that extends along a row of stations I through IV of a ring-spinning machine. The grab 1 comprises a downwardly open abutment cup 8 engageable over the upper end of a tube 9 carried on a respective spindle. Inside the cup 8 a pusher element or slide 4 is provided across from an abutment surface 10.

The slide 4 is carried on a membrane 3 forming a compartment 19 that can be pressurized from a common input passage 7 to push this slide 4 outward in direction A from a withdrawn or retracted position through the illustrated intermediate position in which it clamps the tube 9 against the abutment 10 and in fact further into a fully advanced position if no tube 9 is present. A spring 6 urges the pusher 4 back opposite to the direction A into the retracted position.

In accordance with the invention each such grab 1 is provided with a tube sensor 25 constituted by two contacts 13 and 14 formed on a sleeve 12 in which the pusher 4 slides and a conductive skirt 11 on the rear end of this pusher 4. When the pusher 4 moves forward past the illustrated intermediate position into the fully advanced position its skirt 11 shorts out the two contacts 13 and 14, closing the normally open single-pole single-throw switch formed thereby.

As seen in FIGS. 2 and 3 each contact 13 and 14 is connected to a respective conductor 17 and 18. The former is connected to one side 26 of a supply line and the latter is connected via an indicator lamp 15 to the other side 27 of the supply, which other side is provided with a further indicator 16 itself connected to control means 28 that shuts down the entire doffing/donning apparatus when any of the detectors 25 generates its output. Thus if one of the grabs 1 fails to close over a tube 9 the respective lamp 15 will be illuminated along with the main lamp 16, and the entire device will be shut down. Thus even if no tube 9 is present on a given spindle to be picked up, an error output will be generated to indicate that something is wrong with the machine.

Figure 4:
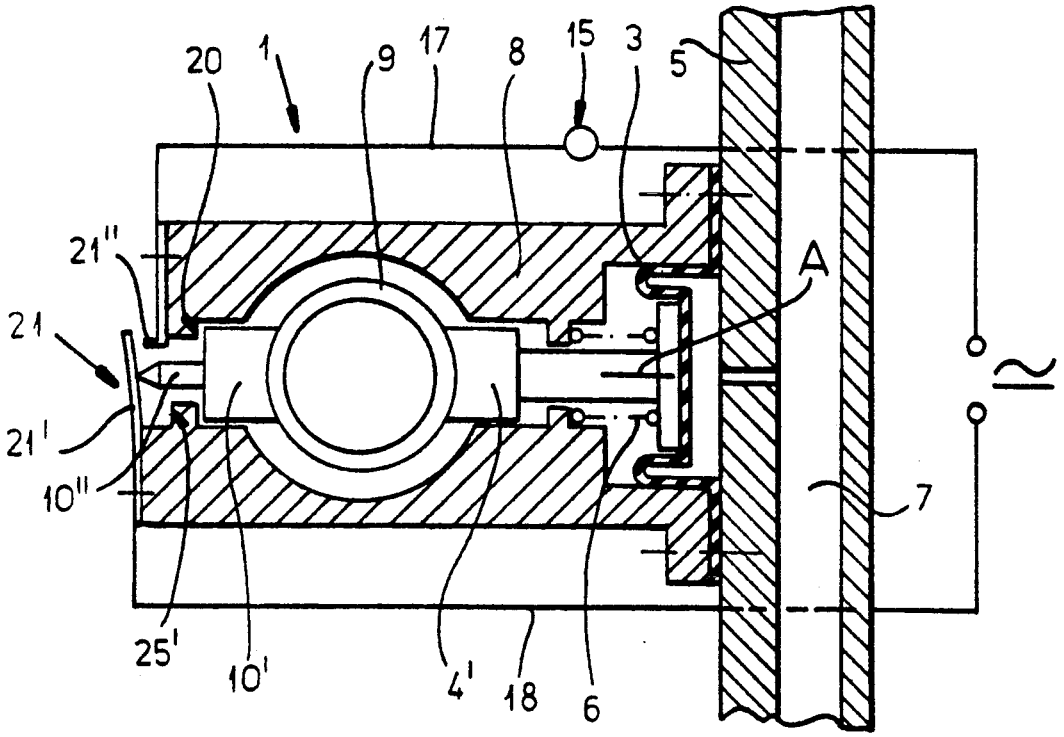
FIG. 4 is a horizontal section through another grab in accordance with this invention.

In FIG. 4 a similar arrangement has an abutment 10' associated with a normally closed single-pole single-throw switch 21 constituted by a pair of contacts 21' and 21" that normally touch each other with the contact 21' acting as a spring to push the abutment 10' into an inner position from the illustrated outer position. Thus this switch 21 forms a detector 25' that generates an output by opening when the respective slide 4' is advanced. Thus once the chamber 9 is pressurized if the switch 21 is not open, this is an indication that no tube 9 has been engaged to push back the abutment 10' and that something is wrong.

Figure 5:
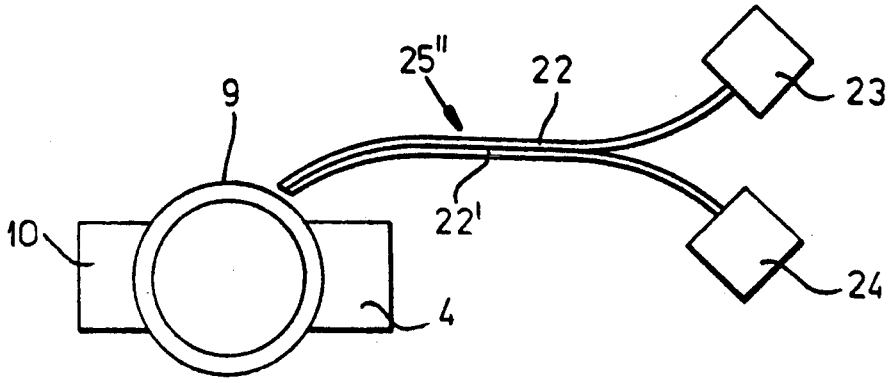
FIG. 5 is a top view of a further grab and sensor according to the invention.

FIG. 5 illustrates a sensor 25" formed by two fiber-optical cables 22 and 22' respectively connected to a light source 23 and a light detector 24. When a tube 9 is in place between the respective pusher element 4 and abutment 10, light from the cable 22 will be reflected by this tube 9 and picked up by the cable 23. When no tube 9 is present the detector 24 will not receive any light and will therefore generate an error signal.

We claim:

1. In a doffing apparatus for removing a row of yarn tubes from a row of upright spindles, the apparatus comprising:

a support;

a row of grabs mounted on the support, each engageable with a respective tube of a respective spindle, and movable for lifting the tubes off the spindles, each grab including an abutment element, a pusher element displaceable toward and away from the abutment element, and means including an actuator for pushing the pusher element toward the abutment element and clamping the respective tube between the elements; and control means including respective switches each connected directly to one of the elements of the respective grab and directly operable by movement of the respective one element for detecting the presence of tubes in the respective grabs and for generating individual outputs respectively corresponding to the absence of tubes in the respective grabs.

2. The doffing apparatus defined in claim 1 wherein each switch is a normally open switch.

3. The doffing apparatus defined in claim 1 wherein each switch is a normally closed switch.

4. The doffing apparatus defined in claim 1 wherein the abutment elements are generally fixed on the support and the pusher elements are each movable from a fully retracted position spaced relatively far from the respective abutment elements to a fully advanced position relatively close to the respective abutment elements and through an intermediate position, the positions being spaced such that on engaging a tube each pusher element is arrested in the intermediate position, the switches being operated in the advanced positions of the respective pusher elements to generate the respective outputs.

5. The doffing apparatus defined in claim 4, further comprising a respective spring in each grab urging the respective pusher element into the fully retracted position.

6. The doffing apparatus defined in claim 1 wherein each abutment is movable between an advanced position relatively close to and a retracted position relatively far from the respective pusher element, the positions being spaced such that on engaging a tube each abutment element is arrested in the retracted position, the apparatus further comprising a respective spring in each grab urging the respective abutment element into the advanced position;

each switch being operated to produce the respective output when the respective abutment element moves into the advanced position.

7. The doffing apparatus defined in claim 1 wherein the control means includes means for stopping the apparatus when one of the outputs is generated.

8. In a doffing apparatus for removing a row of yarn tubes from a row of upright spindles, the apparatus comprising:

a support;

a row of grabs mounted on the support, each engageable with a respective tube of a respective spindle, movable for lifting the tubes off the spindles, and each including;

an abutment element, a pusher element displaceable toward and away from the abutment element, and an actuator for pushing the pusher element toward the abutment element and clamping the respective tube between the element;

means including respective switches at the grabs directly engaging and operable only by movement of one of the elements thereof for detecting the presence of tubes in the respective grabs and for generating individual outputs respectively corresponding to the absence of tubes in the respective grabs; and control means connected to all the sensors for receiving the outputs therefrom and stopping the apparatus on detection of no tube in any of the stations.

9. In a doffing apparatus for removing a row of yarn tubes from a row of upright spindles, the apparatus comprising:

a support;

a row of grabs mounted on the support, each engageable with a respective tube of a respective spindle, and movable for lifting the tubes off the spindles, each grab including an abutment element, a pusher element displaceable toward and away from the abutment element, and means including an actuator for pushing the pusher element toward the abutment element and clamping the respective tube between the elements; and control means including respective normally open switches each connected directly to one of the elements of the respective grab and directly operable by movement of the respective one element for detecting the presence of tubes in the respective grabs and for generating individual outputs respectively corresponding to the absence of tubes in the respective grabs.

* * * * *